US008312872B2

(12) United States Patent
Park et al.

(10) Patent No.: US 8,312,872 B2
(45) Date of Patent: Nov. 20, 2012

(54) OUTDOOR GAS HEATER

(75) Inventors: Jong-Ryul Park, Changwon-si (KR); Jae-Soo Kim, Changwon-si (KR)

(73) Assignee: Leesung Co., Ltd., Changwon-si (KR)

( * ) Notice: Subject to any disclaimer, the term of this patent is extended or adjusted under 35 U.S.C. 154(b) by 184 days.

(21) Appl. No.: 12/839,604

(22) Filed: Jul. 20, 2010

(65) Prior Publication Data

US 2011/0283987 A1 Nov. 24, 2011

(30) Foreign Application Priority Data

May 18, 2010 (KR) ..... 10-2010-0046560
May 18, 2010 (KR) ..... 10-2010-0046561
May 18, 2010 (KR) ..... 10-2010-0046562
May 18, 2010 (KR) ..... 10-2010-0046563

(51) Int. Cl.
*F24H 3/00* (2006.01)

(52) U.S. Cl. ..... 126/116 R; 126/92 AC; 126/92 B; 431/328; 431/329

(58) Field of Classification Search ..... 126/116 R, 126/92 AC, 92 B, 91 R; 431/328, 329, 326, 431/354, 170
See application file for complete search history.

(56) References Cited

U.S. PATENT DOCUMENTS 3,852,025 A * 12/1974 Placek ..... 431/329
5,645,043 A * 7/1997 Long et al. ..... 126/92 AC

* cited by examiner

*Primary Examiner* — Alfred Basichas
(74) *Attorney, Agent, or Firm* — Jefferson IP Law, LLP

(57) ABSTRACT

An outdoor gas heater used in the field is provided. The outdoor gas heater includes a primary combustion net having a dual net structure. A wind-proof cover is provided to protect a thermocouple. Fuel gas is concentrated into a fuel gas discharge hole formed in the wind-proof cover so that an initial ignition performance is improved. A support is provided to support the outdoor gas heater from the top surface of a gas container. A fuel gas inlet tube is vertically installed between a head unit and a safety valve while being spaced apart from an adjustment handle, and a fire extinguishing safety device is provided behind the fuel gas inlet tube, so that the fire extinguishing safety device is hidden by the fuel gas inlet tube, thereby minimizing a volume of the gas heater without degrading aesthetic appearance of the gas heater.

14 Claims, 15 Drawing Sheets

OUTDOOR GAS HEATER

PRIORITY

This application claims the benefit under 35 U.S.C. §119 (a) of a Korean patent application filed on May 18, 2010 in the Korean Intellectual Property Office and assigned Serial No. 10-2010-0046560, a Korean patent application filed on May 18, 2010 in the Korean Intellectual Property Office and assigned Serial No. 10-2010-0046561, a Korean patent application filed on May 18, 2010 in the Korean Intellectual Property Office and assigned Serial No. 10-2010-0046562, and a Korean patent application filed on May 18, 2010 in the Korean Intellectual Property Office and assigned Serial No. 10-2010-0046563, the entire disclosures of which are hereby incorporated by reference.

BACKGROUND OF THE INVENTION

1. Field of the Invention

The present invention relates to a portable outdoor gas heater, which can be used in the field. More particularly, the present invention relates to an outdoor gas heater having a backfire arresting function, in which the outdoor gas heater can be prevented from being overheated while losing the heating function due to the backfire, thereby ensuring safety when using the outdoor gas heater.

In addition, the present invention relates to an outdoor gas heater having an anti-fire extinguishing function, capable of preventing the performance degradation caused by the fire extinguishing phenomenon due to the wind and improving the initial ignition performance.

The present invention relates to an outdoor gas heater, which is not shaken when a user manipulates an adjustment handle so that the user can conveniently use the outdoor gas heater.

In addition, the present invention relates to an outdoor gas heater, in which a fire extinguishing safety device, which shuts off fuel gas being fed when the gas heater comes down, is appropriately installed in the outdoor gas heater in such a manner that the volume of the outdoor gas heater can be minimized and the aesthetic appearance of the outdoor gas heater cannot be deteriorated while facilitating the installation work for the fire extinguishing safety device.

2. Description of the Related Art

FIGS. 13 and 14 are perspective views showing a head unit of a gas heater according to the related art.

Referring to FIGS. 13 and 14, the portable outdoor gas heater includes a head unit 100 and a gas feeding unit 200 for feeding fuel gas into a mixing chamber 110 of the head unit 100. The head unit 100 includes the mixing chamber 110 for mixing gas with air, a primary combustion net 120 fixedly coupled to an upper end of the mixing chamber 110 to perform the primary combustion of the gas by controlling the flow of gas supplied to the mixing chamber 110, a secondary combustion net 130 fixedly coupled onto the primary combustion net 120 to perform the secondary combustion of the gas, and a reflective plate 140 fixedly coupled onto the secondary combustion net 130, in which the mixing chamber 110, the primary combustion net 120 and the secondary combustion net 130 are sequentially stacked. In the case of the primary and second combustion nets 120 and 130 of the head unit 100, the primary combustion net 120 has a mesh size smaller than a mesh size of the secondary combustion net 130 for the purpose of heating efficiency and safety. In detail, the mesh size of the secondary combustion net 130 is larger than the mesh size of the primary combustion net 120 by ten times or more.

The outdoor gas heater having the above structure can be conveniently used in the field without causing problems under the 4 mph (min/hour) wind. However, when the wind over 4 mph blows, the wind is infiltrated into the mixing chamber 110 of the head unit 100 by passing through the secondary combustion net 130 and the primary combustion net 120, thereby causing the backfire phenomenon.

That is, since the speed of external air introduced into the mixing chamber 110 is faster than the discharge speed of combustion gas, heat is not emitted to the outside, so that the heater may not perform its original function. If such a backfire phenomenon continues, gas combustion may occur at the lower portion of the mixing chamber or at the region where a nozzle is provided, so that the heater is overheated.

In extreme cases, users may get burned, or the flame spreads so that a fire breaks out.

For this reason, the outdoor gas heater is not available under the strong wind.

In addition, an ignition plug 150 used for auto-ignition and a thermocouple 160 used for detecting combustion heat are provided on the reflective plate 140 above the second combustion net 130, and the thermocouple 160 is connected to a safety valve 230 coupled with a fuel gas inlet tube 210 of a gas feeding unit 200. If the thermocouple 160 detects that combustion heat reaches the predetermined temperature through the stable ignition operation, the safety valve 230 is open to continuously feed the gas. In addition, if the thermocouple 160 detects that the combustion heat falls below the predetermined temperature due to the backfire caused by the wind, the safety valve 230 is closed to shut off the gas being fed, so that automatic fire extinguishing is achieved to ensure safety against the backfire.

However, the outdoor gas heater is mainly used in the field and the thermocouple 160 is exposed out of the head unit 100, so that the thermocouple 160 may be affected by the wind. That is, the thermocouple 160 is easily cooled down when it makes contact with the wind so that the temperature of combustion heat detected by the thermocouple 160 may fall down. For this reason, the fire extinguishing is frequently performed even if the backfire phenomenon does not occur.

Since the fire is frequently extinguished during the use of the gas heater, the user must operate again the gas heater, causing inconvenience to the user.

In addition, the fuel gas inlet tube 210 is coupled to the mixing chamber 110 of the head unit 100 just below the mixing chamber 110, the safety valve 230 coupled with a gas feeding nozzle 220 is coupled to the fuel gas inlet tube 210 just below the fuel gas inlet tube 210, and a connection member 240 is coupled to the safety valve 230 just below the safety valve 230. Further, a fitting unit 250 fitted to a gas container 300 is provided at one side of the connection member 240 and an adjustment handle 260 is provided at the other side of the connection member 240 to adjust the heating power by controlling the amount of gas to be fed.

In order to use the gas heater having the above structure, the fitting unit 250 is fitted into a gas discharge port 310 formed at the upper end of the gas container 300 and the user operates the gas heater by rotating the adjustment handle 260.

However, since the gas heater is supported only by the fitting unit 250 fitted into the gas discharge port 310, the gas heater may be shaken when the user manipulates the adjustment handle 260, thereby causing inconvenience to use the gas heater.

If ignition occurs by operating the adjustment handle 260, the fuel gas is continuously fed through the gas feeding nozzle and the gas heater is continuously operated through the combustion of the fuel gas. However, since the gas heater is mainly installed outside the house, flame may spread if the strong wind blows or the gas heater comes down due to external impact applied thereto, in extreme case, a fire breaks out.

In order to prevent such a dangerous situation, a fire extinguishing safety device is installed in the gas heater to automatically shut off the fuel gas when the gas heater comes down.

However, if the fire extinguishing safety device is installed in the gas heater, the volume of the gas heater is increased so that the aesthetic appearance of the gas heater is deteriorated and the connection work to the gas container is inconvenient. In addition, the ignition work to use the gas heater is difficult and the adjustment handle is not easily manipulated. Therefore, it is necessary to appropriately install the fire extinguishing safety device in the gas heater to solve the above problems and inconvenience.

SUMMARY OF THE INVENTION

An aspect of the present invention is to address at least the above-mentioned problems and/or disadvantages and to provide at least the advantages described below. Accordingly, an aspect of the present invention is to provide an outdoor gas heater having a backfire arresting function to ensure safety, in which elements of the outdoor gas heater are improved to prevent external air from being easily introduced into a mixing chamber.

In accordance with an aspect of the present invention, an outdoor gas heater is provided. The heater includes a thermocouple which is rarely affected by external air so that fire extinguishing is performed only based on the temperature of a mixing chamber, thereby ensuring safety and preventing inconvenience of use caused by unintentional fire extinguishing.

In accordance with another aspect of the present invention, an outdoor gas heater is provided. The heater includes a support unit to prevent the outdoor gas heater from being shaken when a user manipulates an adjustment handle to use the outdoor gas heater.

In accordance with a further aspect of the present invention, an outdoor gas heater is provided. The heater includes a fire extinguishing safety device which is appropriately installed in the outdoor gas heater in such a manner that a volume of the outdoor gas heater can be minimized without deteriorating the aesthetic appearance of the outdoor gas heater while facilitating the installation work and use of the fire extinguishing safety device.

The outdoor gas heater includes a primary combustion net having inner and outer nets overlapped with each other such that external layer can be prevented from being introduced into the mixing chamber, thereby preventing the backfire phenomenon during the use of the outdoor gas heater. The primary combustion net is prepared through the spot welding such that the inner and outer nets are overlapped with each other while forming a uniform gap therebetween, thereby ensuring the backfire arresting function.

In addition, a wind-proof cover is provided for a thermocouple to prevent the thermocouple from being affected by external air. The wind-proof cover is formed with a fuel gas discharge hole to collect fuel gas supplied from the mixing chamber such that the fuel gas can be effectively discharged through the fuel gas discharge hole, thereby improving the initial ignition performance of an ignition plug.

Further, a fuel gas inlet tube having a coupling hole is fixedly coupled with a safety valve having a coupling hole by a fixing screw, which is screw-coupled into the coupling holes of the fuel gas inlet tube and the safety valve, thereby forming a support that supports the gas heater, which is coupled to a gas container, from the top of the gas container.

In addition, the fuel gas inlet tube is vertically installed between a head unit and the safety valve so that a predetermined space is formed between the head unit and the safety valve while being spaced apart from the adjustment handle. In this regard, the fire extinguishing safety device is installed to the fuel gas inlet tube. In particular, the fire extinguishing safety device is installed behind the fuel gas inlet tube such that the fire extinguishing safety device is hidden by the fuel gas inlet tube when viewed from the front of the fuel gas inlet tube, thereby minimizing the volume of the outdoor gas heater without degrading the aesthetic appearance of the outdoor gas heater.

Since the outdoor gas heater is equipped with the primary combustion net having the dual structure, the external air rarely infiltrates into the mixing chamber even if relatively strong wind blows to the outdoor gas heater, so that the backfire phenomenon and accident can be prevented.

In addition, under the weak-wind condition, which does not cause the backfire phenomenon, the thermocouple is not easily cooled down, so that inconvenience derived from the unintentional fire extinguishing can be prevented during the use of the outdoor gas heater.

Further, the support may securely couple the fuel gas inlet tube with the connection member, so that the gas heater is not shaken when the user manipulates the adjustment handle, thereby solving the problem of inconvenience caused by the gas heater being shaken.

In addition, the volume of the outdoor gas heater may not be increased even if the fire extinguishing safety device is installed in the outdoor gas heater, so that the aesthetic appearance of the outdoor gas heater may not be deteriorated and the user can easily manipulate the outdoor gas heater without inconvenience, thereby ensuring safety.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of certain exemplary embodiments of the invention will be more apparent from the following description taken in conjunction with the accompanying drawings, in which.

Throughout the drawings, it should be noted that like reference numbers are used to depict the same or similar elements, features, and structures.

DETAILED DESCRIPTION OF EXEMPLARY EMBODIMENTS

The following description with reference to accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions are omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention are provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
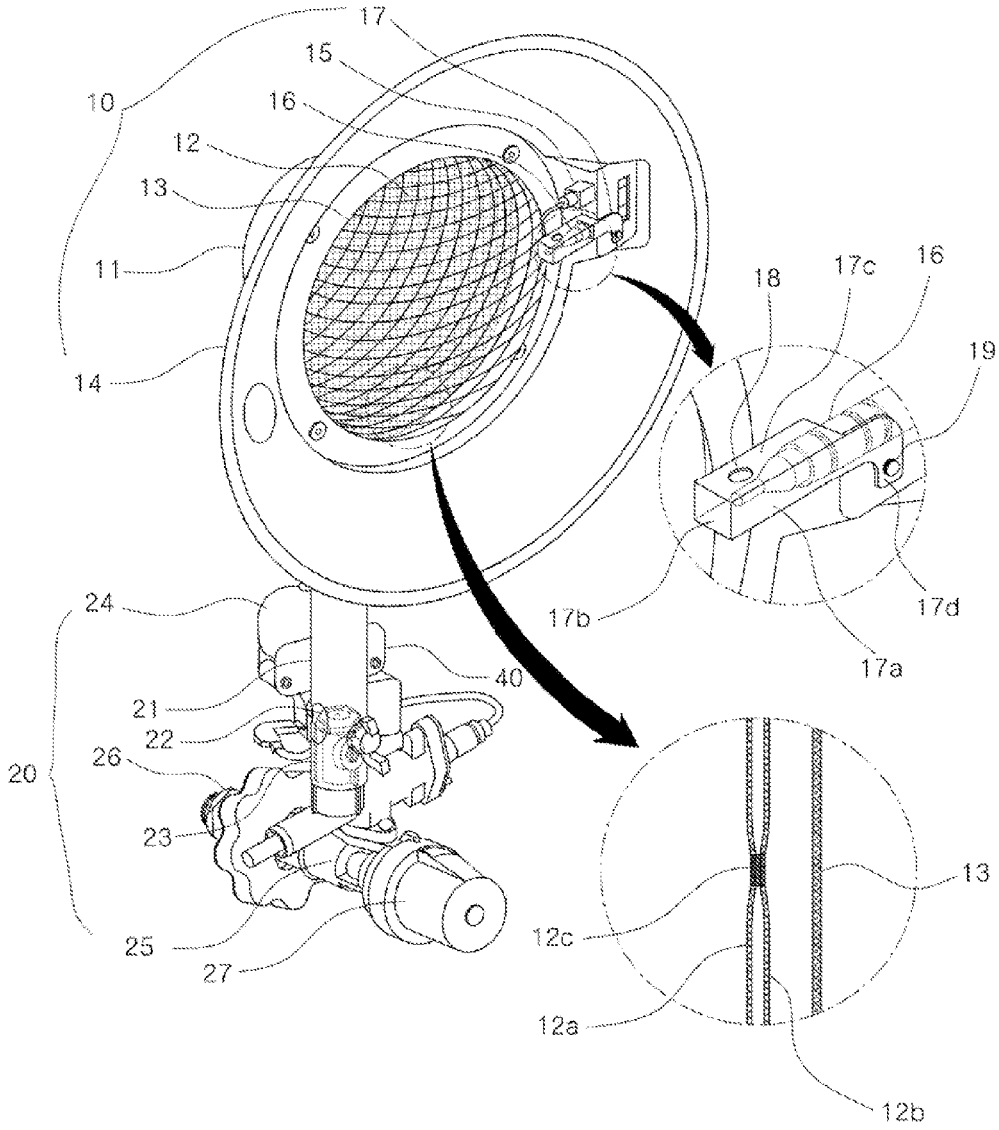
FIG. 1 is a perspective view showing a gas heater according to an exemplary embodiment of the present invention.

FIG. 1 is a perspective view showing a gas heater according to one an exemplary embodiment of the present invention.

Figure 2:
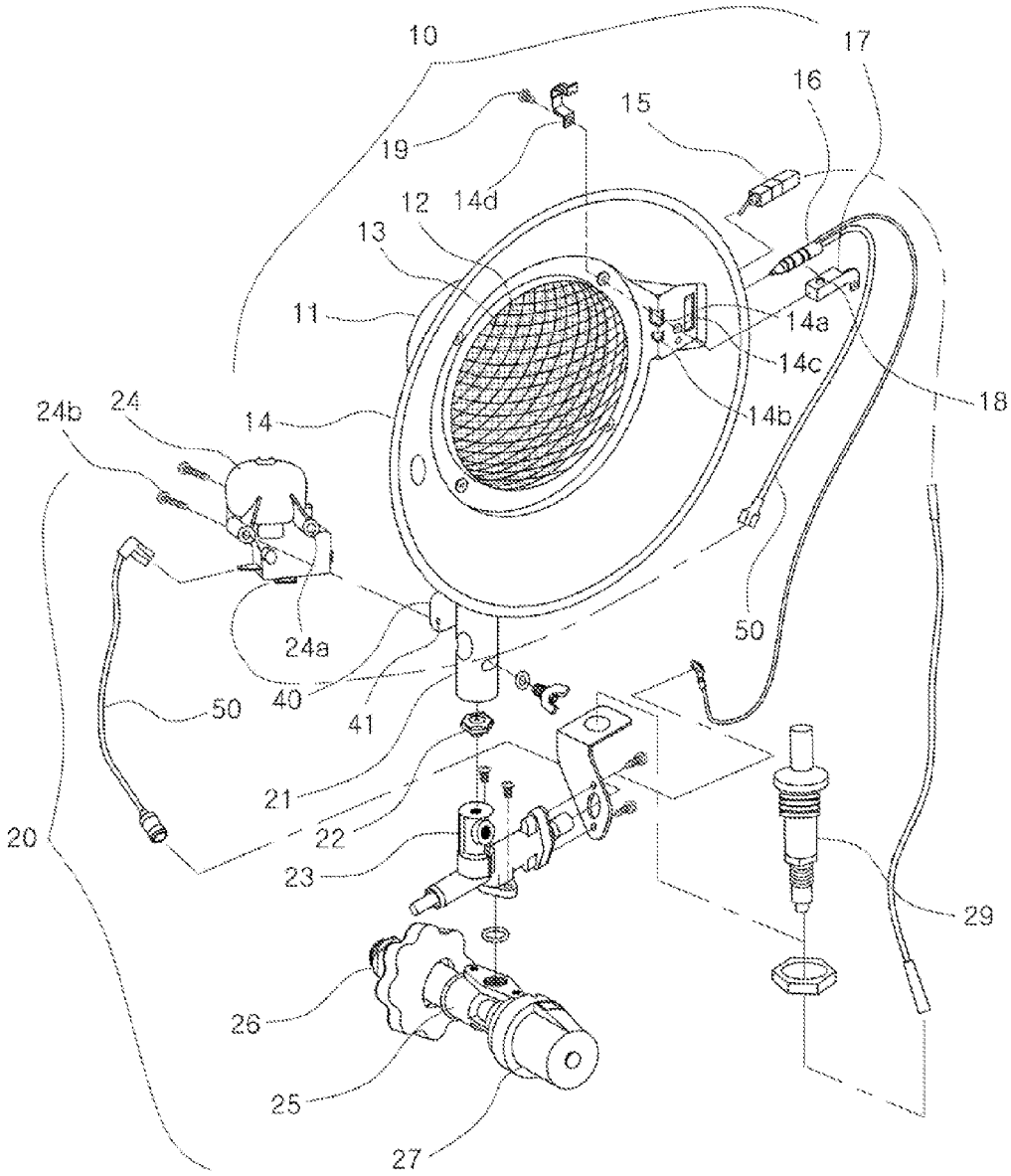
FIG. 2 is an exploded perspective view showing a gas heater according to an exemplary embodiment of the present invention.

FIG. 2 is an exploded perspective view showing a gas heater according to an exemplary embodiment of the present invention.

Referring to FIGS. 1 and 2, an outdoor gas heater includes a head unit 10 and a gas feeding unit 20 for feeding fuel gas into the head unit 10.

Figure 3:
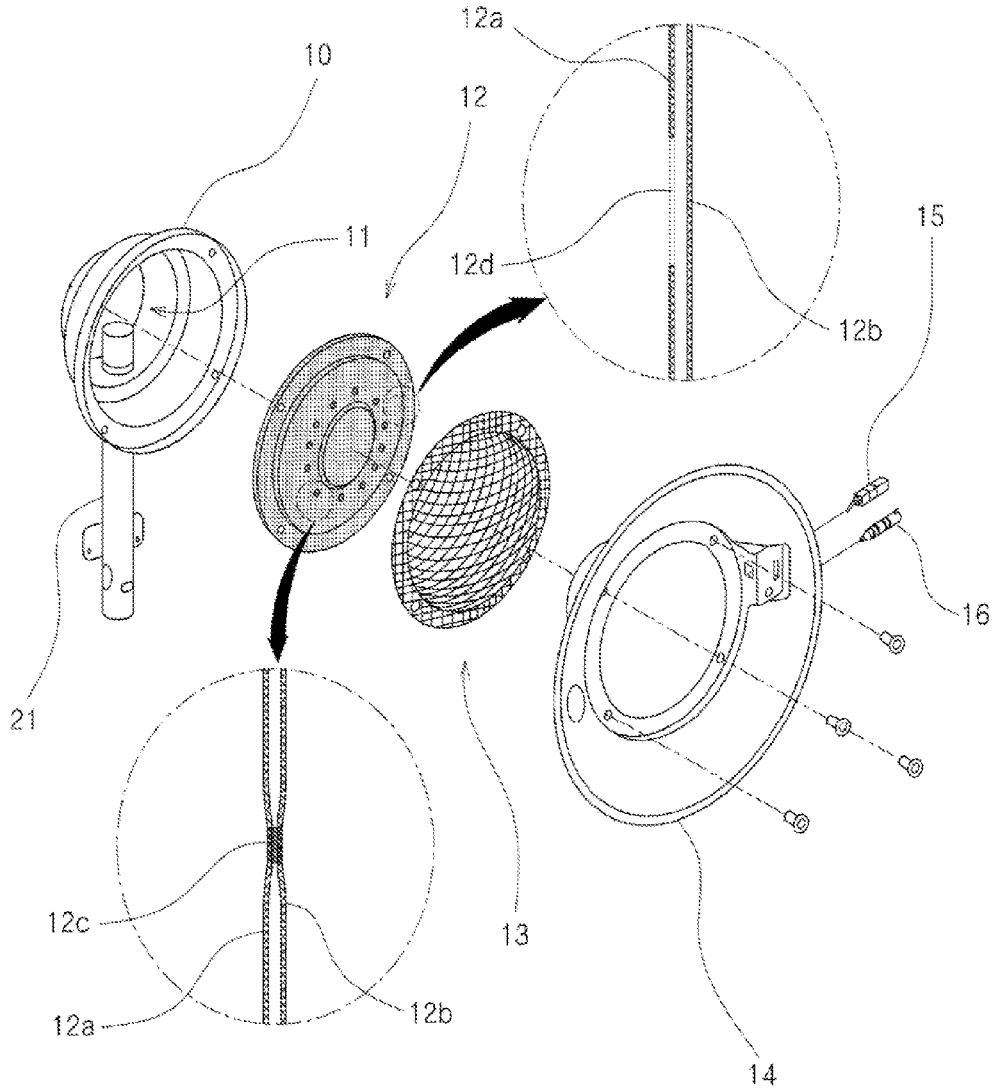
FIG. 3 is an exploded perspective view showing a head unit shown in FIG. 1.

FIG. 3 is an exploded perspective view showing a head unit shown in FIG. 1.

Referring to FIG. 3, the head unit 10 includes a mixing chamber 11 having a space section for mixing gas with air for combustion, a primary combustion net 12 fixedly coupled to an upper end of the mixing chamber 11 to perform the primary combustion of the gas by controlling the flow of the gas supplied from a fuel gas inlet tube 21 connected to a lower portion of the mixing chamber 11, a secondary combustion net 13 fixedly coupled onto the primary combustion net 12 to perform the secondary combustion of the gas, and a reflective plate 14 fixedly coupled onto the secondary combustion net 13 to collect combustion heat in the front direction. The reflective plate 14 is provided with an ignition plug 15 used for auto-ignition and a thermocouple 16 used for detecting combustion heat such that the ignition plug 15 and the thermocouple 16 are located above the secondary combustion net 13.

A gas feeding unit 20 includes the fuel gas inlet tube 21 communicated with the mixing chamber 11 of the head unit 10, a gas feeding nozzle 22 connected to the fuel gas inlet tube 21, a safety valve 23 coupled with the gas feeding nozzle 22, a piezoelectric member 29 connected to the ignition plug 15, and a connection member 25 coupled to the safety valve 23. A fitting unit 26 is provided at one side of the connection member 25 and an adjustment handle 27 is provided at the other side of the connection member 25 to adjust the heating power by controlling the amount of gas to be fed.

If the thermocouple 16 detects that combustion heat reaches the predetermined temperature through the stable ignition operation, the safety valve 23 is open to continuously feed the gas. In addition, if the thermocouple 16 detects that the combustion heat falls below the predetermined temperature, the safety valve 23 is closed to shut off the gas being fed, so that automatic fire extinguishing is achieved.

According to an exemplary embodiment of the present invention, the primary combustion net 12 includes inner and outer combustion nets 12*a* and 12*b* having the same size. The inner and outer combustion nets 12*a* and 12*b* are overlapped with each other to allow the primary combustion net 12 to have the backfire arresting function.

The inner and outer combustion nets 12*a* and 12*b* can be coupled with each other by various fixing units, such as a rivet or a wire. Preferably, the inner and outer combustion nets 12*a* and 12*b* are welded to each other through a spot welding section 12*c* formed by the spot welding process. In this case, a uniform gap can be formed between the inner and outer combustion nets 12*a* and 12*b*, instead of an irregular gap, which may be formed due to difference in thermal expansion coefficient between the inner and outer combustion nets 12*a* and 12*b* caused by combustion heat, so that the backfire arresting function is enhanced.

A plurality of spot welding sections 12*c* can be formed in the primary combustion net 12 while forming a circular pattern at the center of the inner and outer combustion nets 12*a* and 12*b*. In this case, the uniform gap can be formed between the inner and outer combustion nets 12*a* and 12*b*, so that the optimum backfire arresting function can be realized.

Figure 4A:
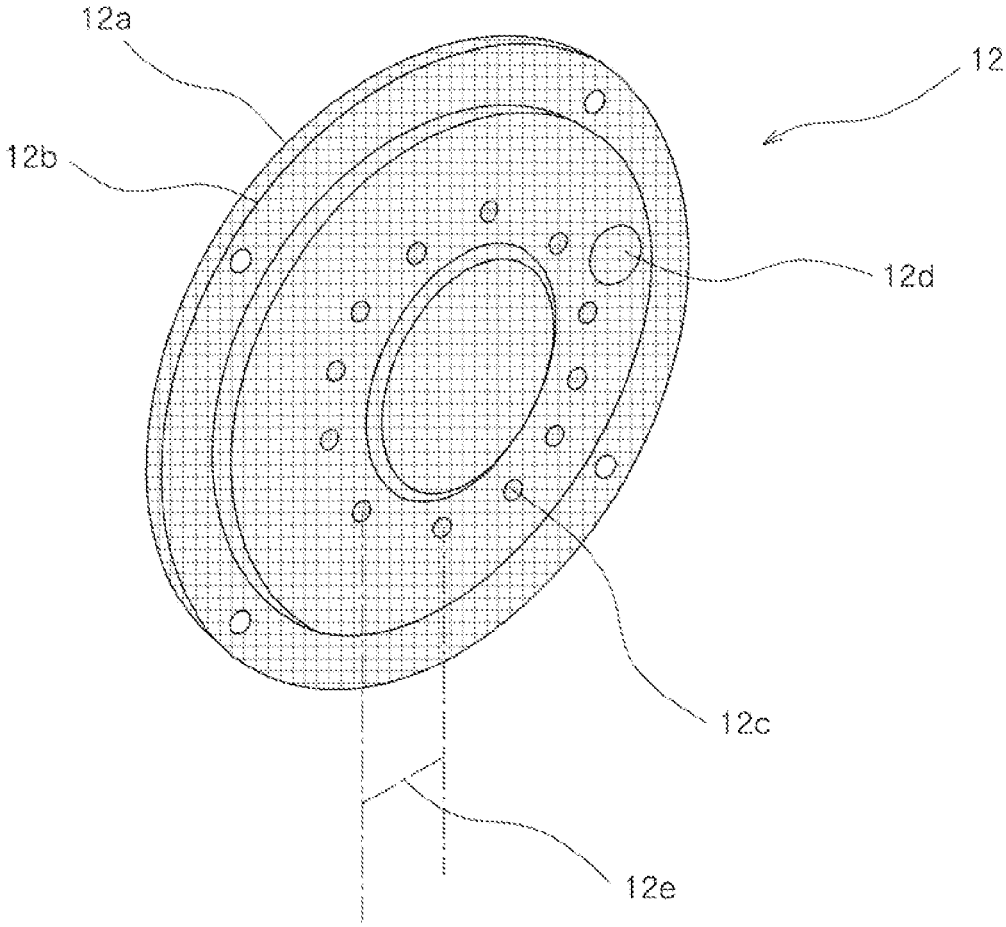
FIG. 4A is a perspective view showing the structure of a primary combustion net equipped in a gas heater according to an exemplary embodiment of the present invention.

FIG. 4A is a perspective view showing the structure of a primary combustion net equipped in a gas heater according to an exemplary embodiment of the present invention.

Figure 4B:
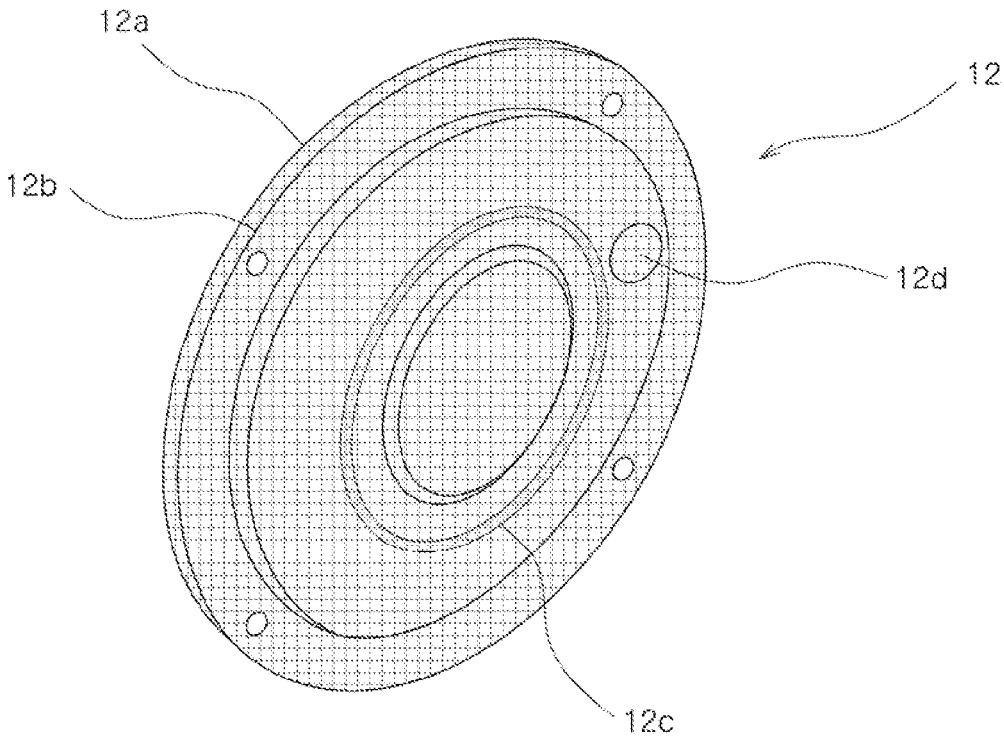
FIG. 4B is a perspective view showing the structure of a primary combustion net equipped in a gas heater according to an exemplary embodiment of the present invention.

FIG. 4B is a perspective view showing the structure of a primary combustion net equipped in a gas heater according to an exemplary embodiment of the present invention.

Referring to FIG. 4B, a spot welding section 12*c* can be prepared in the form of a strip. Preferably, the spot welding section 12*c* includes a plurality of spots spaced apart from each other at a regular interval 12*e* as shown in FIG. 4A. In this case, the spot welding section 12*c* may not interfere with the combustion gas and the primary combustion net 12 can be prevented from being overheated.

In addition, a perforation hole 12*d* is formed in the inner combustion net 12 such that the fuel gas can be effectively discharged through the perforation hole 12*d*. The perforation hole 12*d* of the primary combustion net 12 is aligned in the same vertical line with the ignition plug 15 to improve the initial ignition performance.

A reflective plate 14 is fixedly coupled onto a secondary combustion net 13 such that heat generated from the secondary combustion net 13 can be collected and emitted in the front direction. The reflective plate 14 is provided with an ignition plug 15 such that the ignition plug 15 is located above the second combustion net 13.

The primary combustion net 12 has a wire thickness of about 0.25 mm and a mesh size of about 38 mesh, and the secondary combustion net 13 has a wire thickness of about 0.6 to 1.0 mm and a mesh size of about 6 mesh such that the backfire may not occur under the 10 mph wind.

Figure 5:
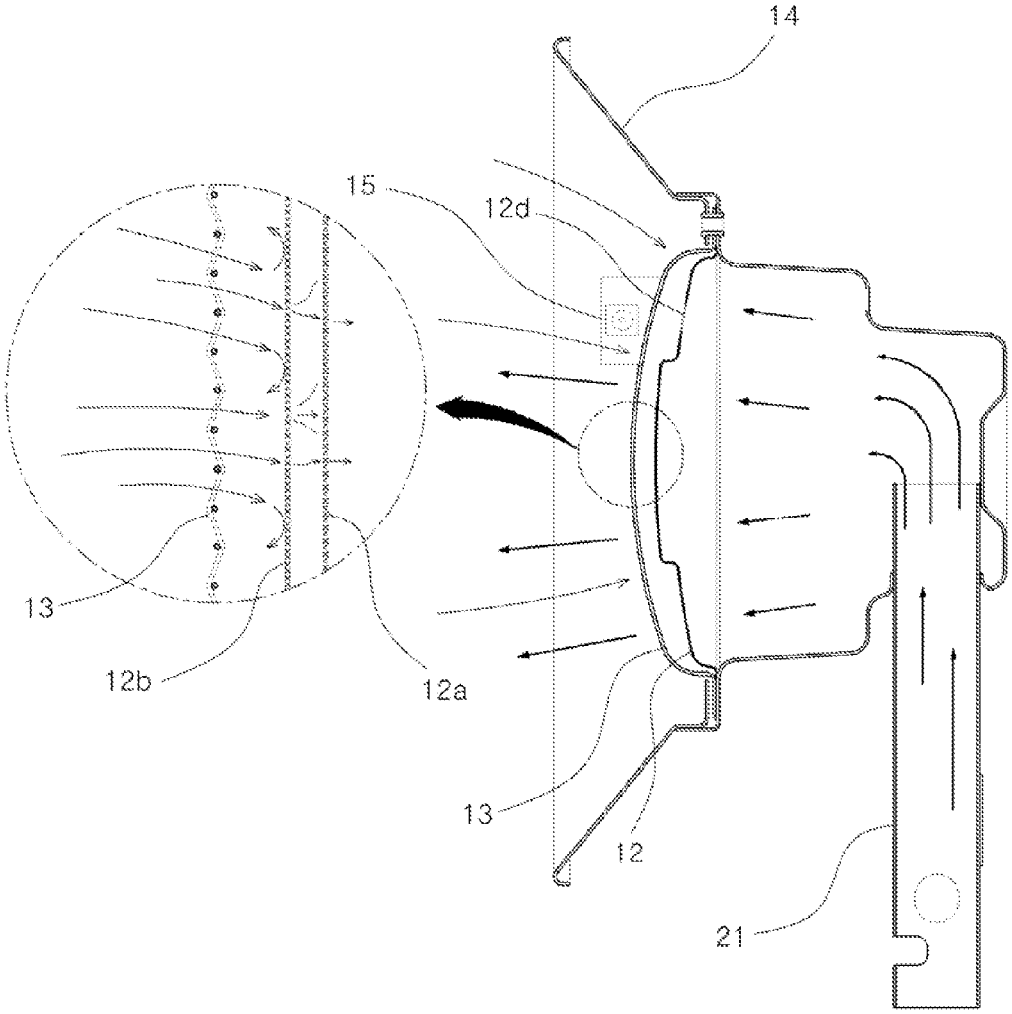
FIG. 5 is a reference view showing a reverse-wind shut-off state of a gas heater according to an exemplary embodiment of the present invention.

FIG. 5 is a reference view showing a reverse-wind shut-off state of a gas heater according to an exemplary embodiment of the present invention.

Referring to FIG. 5, the outdoor gas heater including a primary combustion net 12 having the dual net structure, as shown in the external air passing through a secondary combustion net 13 partially passes through an inner combustion net 12*a* of the primary combustion net 12, and then a very small amount of the external air passes through an outer combustion net 12*b* of the primary combustion net 12. Thus, the backfire phenomenon can be prevented when the outdoor gas heater is used in the field unless the strong wind blows.

Figure 6:
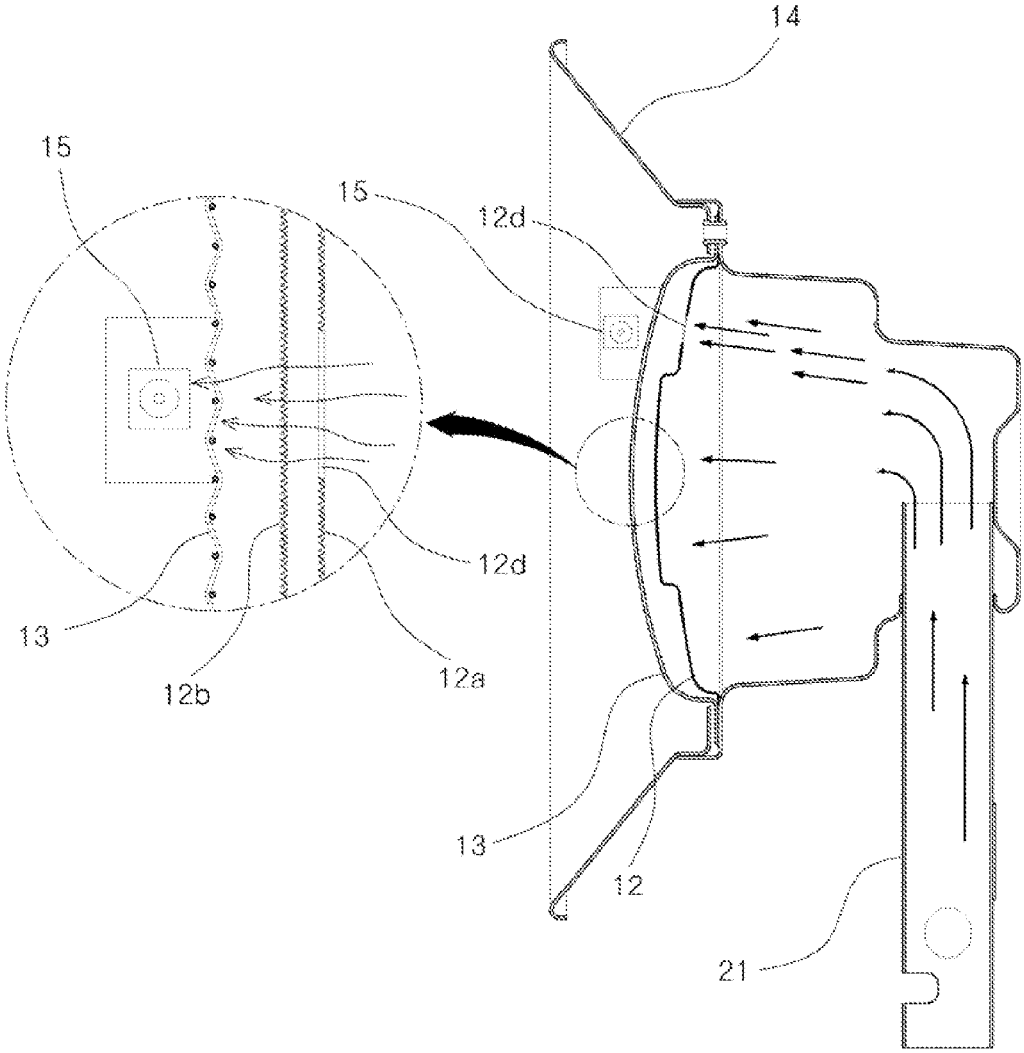
FIG. 6 is a reference view showing an initial ignition state of a gas heater according to an exemplary embodiment of the present invention.
Figure 7:
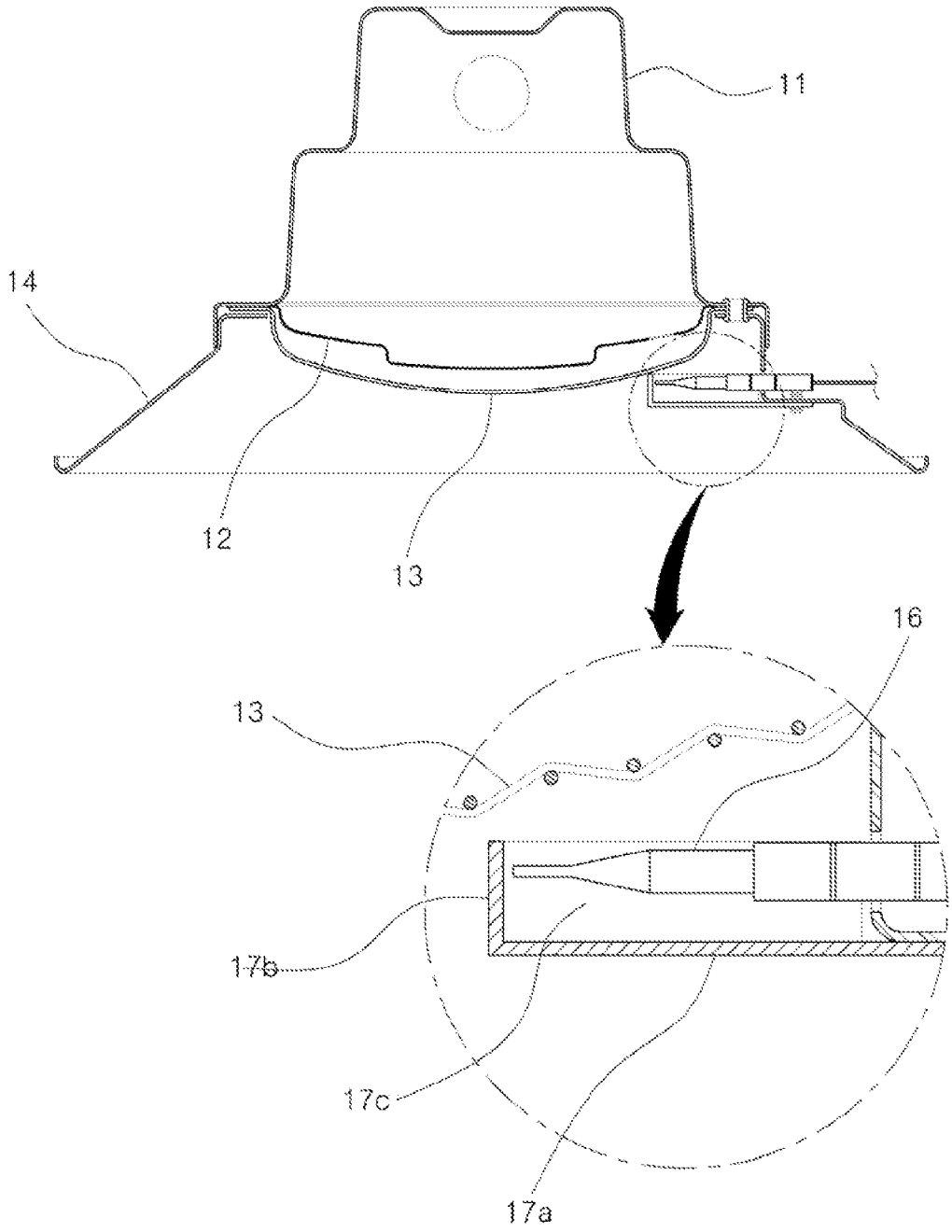
FIG. 7 is a transverse sectional view of FIG. 1.
Figure 8:
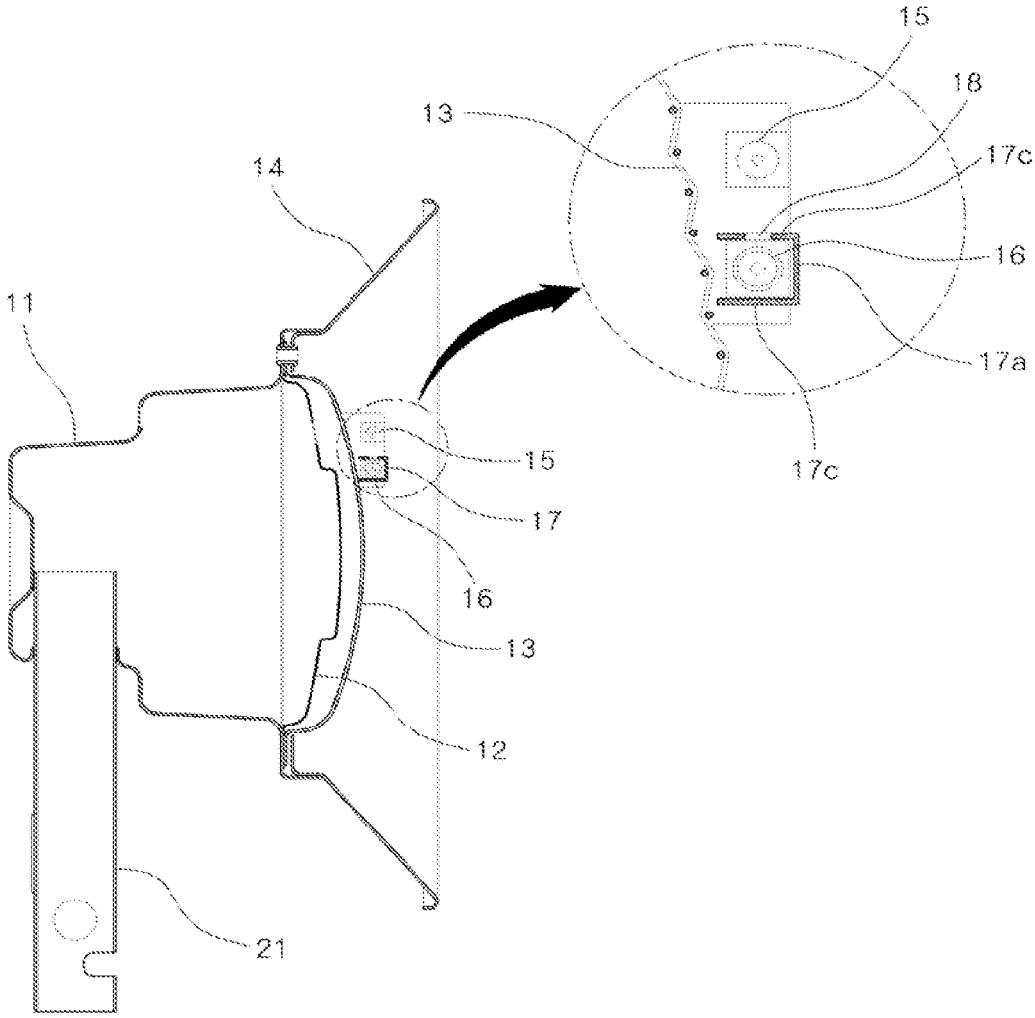
FIG. 8 is a longitudinal sectional view of FIG. 1.
Figure 9:
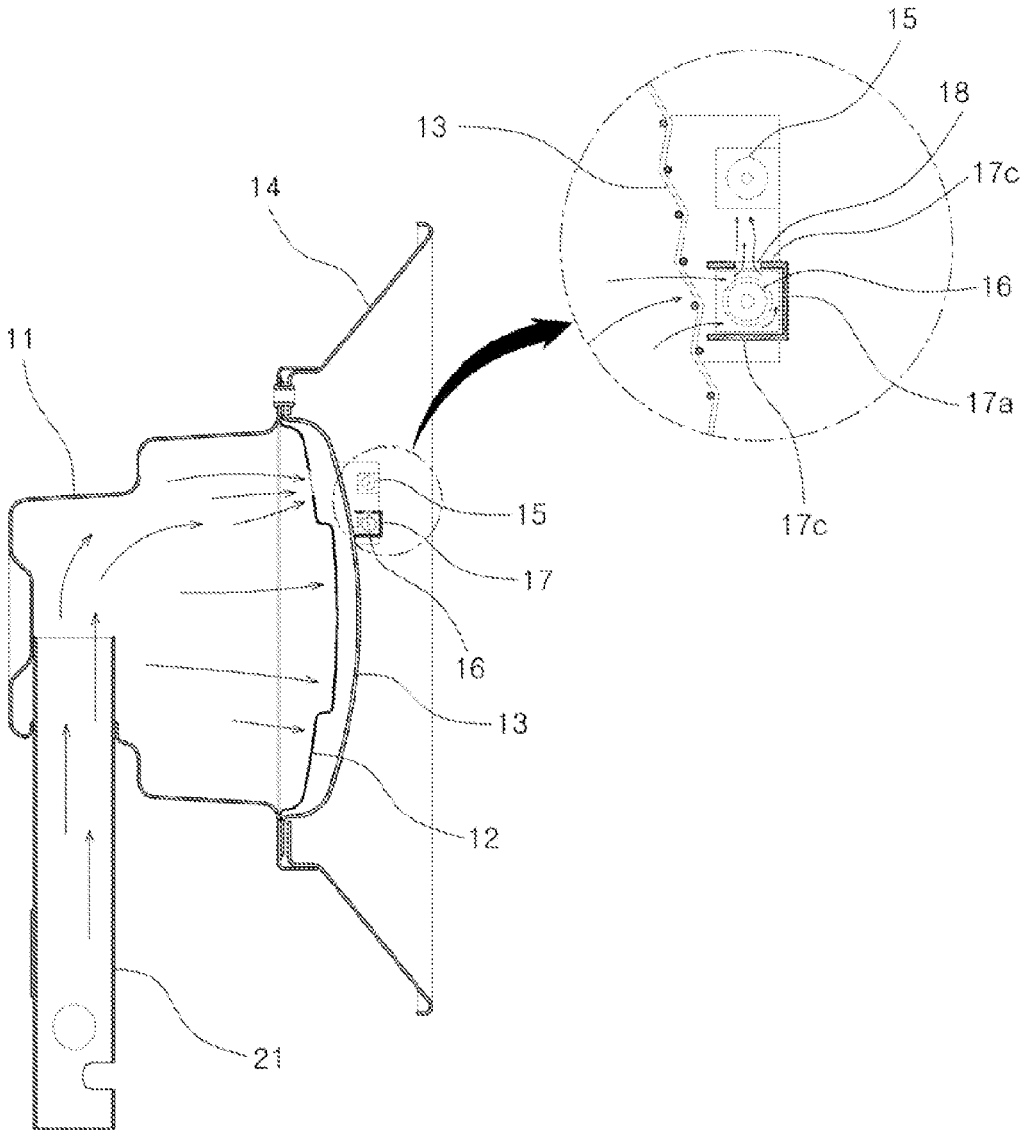
FIG. 9 is a reference view showing an initial ignition state of a gas heater according to an exemplary embodiment of the present invention.

FIG. 6 is a reference view showing an initial ignition state of a gas heater according to an exemplary embodiment of the present invention.

Referring to FIG. 6, when the gas heater initially ignites, the combustion gas is concentrated onto a region where an ignition plug 15 is located through a perforation hole 12*d* formed in an inner combustion net 12*a* of a primary combustion net 12, so that the initial ignition performance can be improved.

Further, according to an exemplary embodiment of the present invention, a wind-proof cover 17 is provided at a thermocouple 16 to block the external air, so that influence of the wind upon the gas heater may be minimized and unintentional fire extinguishing of the outdoor gas heater may be prevented.

The wind-proof cover 17 includes a top surface 17*a*, a front surface 17*b* and both lateral sides 17*c* to surround the thermocouple 16 exposed to the outside. A bottom surface of the wind-proof cover 17 is open to optimally detect the temperature derived from the combustion heat.

In addition, the wind-proof cover 17 can be formed by bending a metal plate. In this case, an extension surface 17*d* is formed at a rear of the top surface 17*a* and the wind-proof cover 17 is fixed to one side of a reflective plate 14 by using a fixing unit 19.

The wind-proof cover 17 has a fuel gas discharge hole 18 located corresponding to the ignition plug 15. Thus, the fuel gas supplied to a head unit 10 during the initial ignition may be collected in the wind-proof cover 17 and concentrated onto the ignition plug 15 through a fuel gas discharge hole 18, so that the initial ignition performance can be improved.

The reflective plate 14 is formed with an ignition plug insertion hole 14*a* and a thermocouple insertion hole 14*b*. In addition, a bracket coupling hole 14*c* is formed at a rear of the ignition plug insertion hole 14*a* and the thermocouple insertion hole 14*b*. The bracket coupling hole 14*c* is coupled with a bending surface of a bracket 14 used for mounting the ignition plug 15 and the thermocouple 16 on the reflective plate 14, so that the ignition plug 15 and the thermocouple 16 can be securely mounted on the reflective plate 14. The bracket 14*d* is fixed to the reflective plate 14 together with the wind-proof cover 17 by the fixing unit 19.

Figure 10:
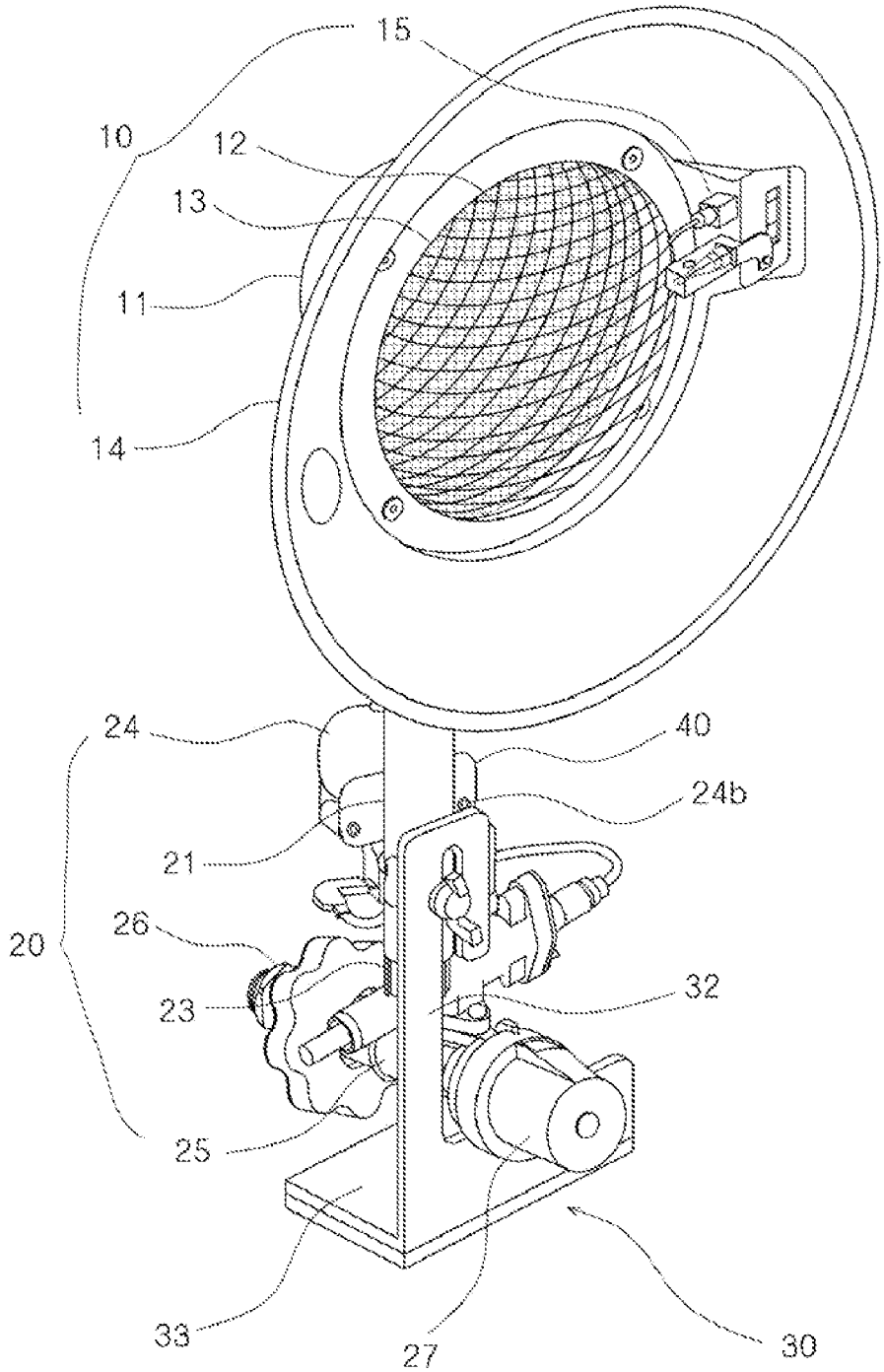
FIG. 10 is a perspective view showing a gas heater equipped with a support according to an exemplary embodiment of the present invention.
Figure 11:
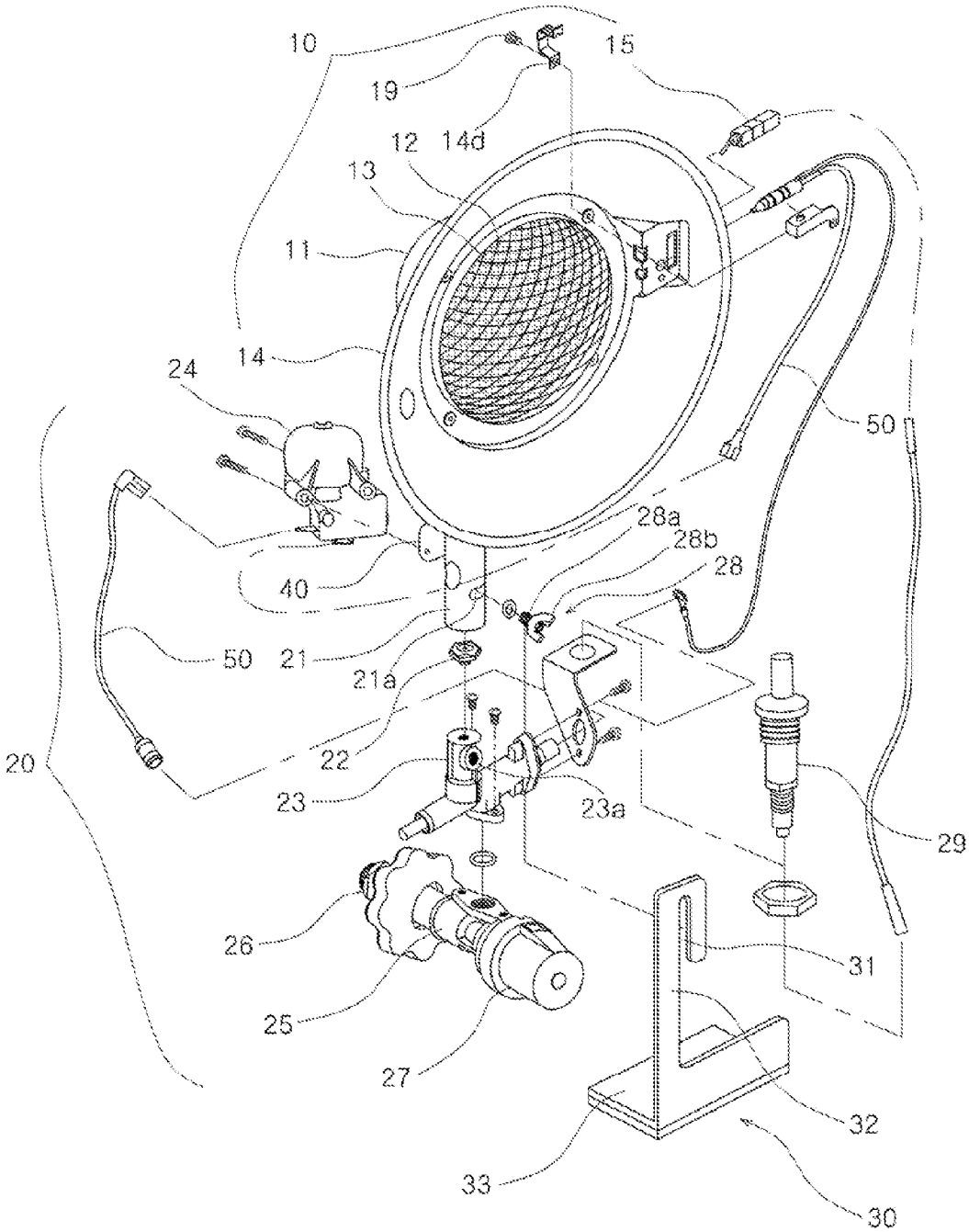
FIG. 11 is an exploded perspective view showing a gas heater equipped with a support according to an exemplary embodiment of the present invention.
Figure 12:
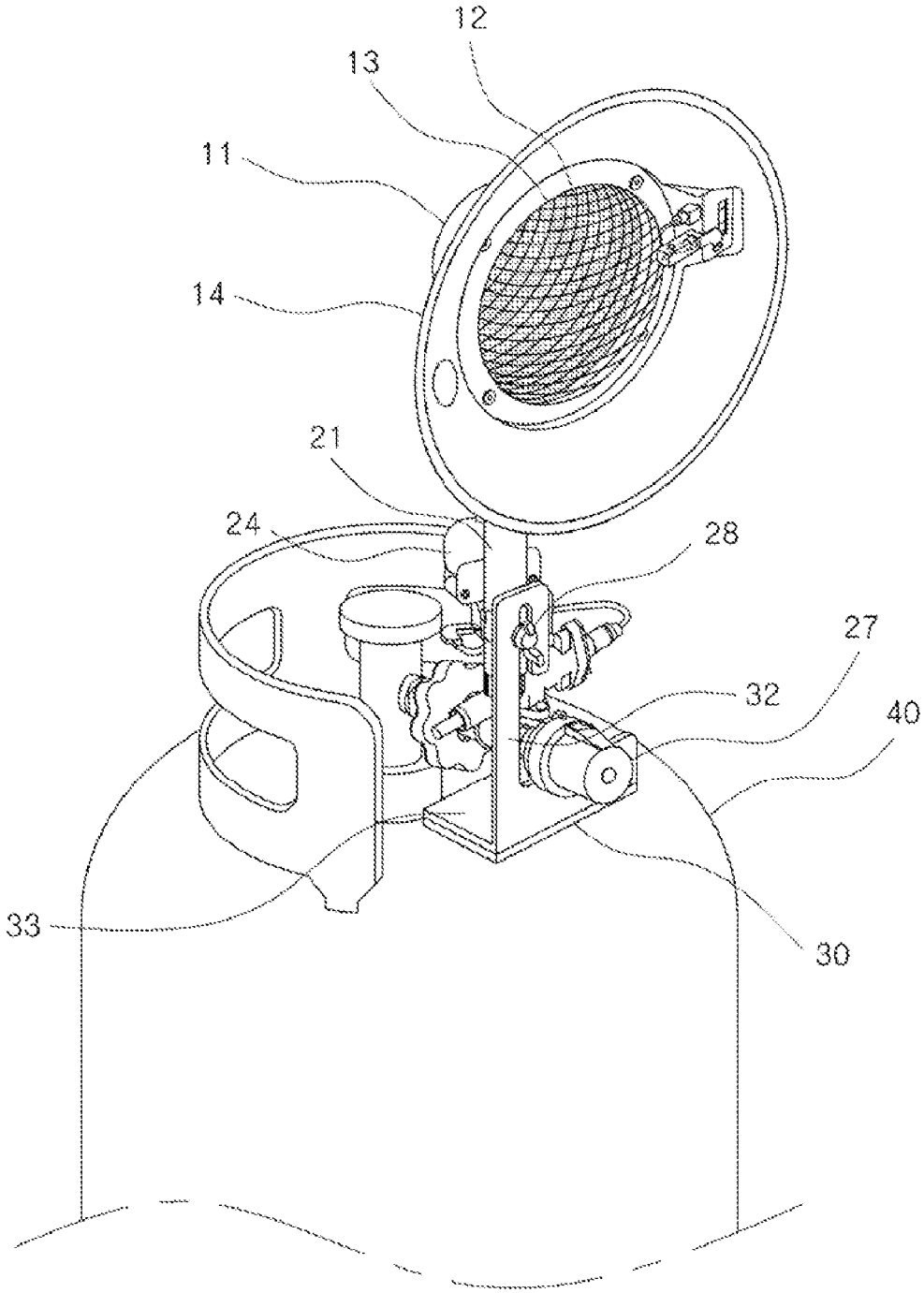
FIG. 12 is a perspective view showing a gas heater installed on a gas container according to an exemplary embodiment of the present invention.
Figure 13:
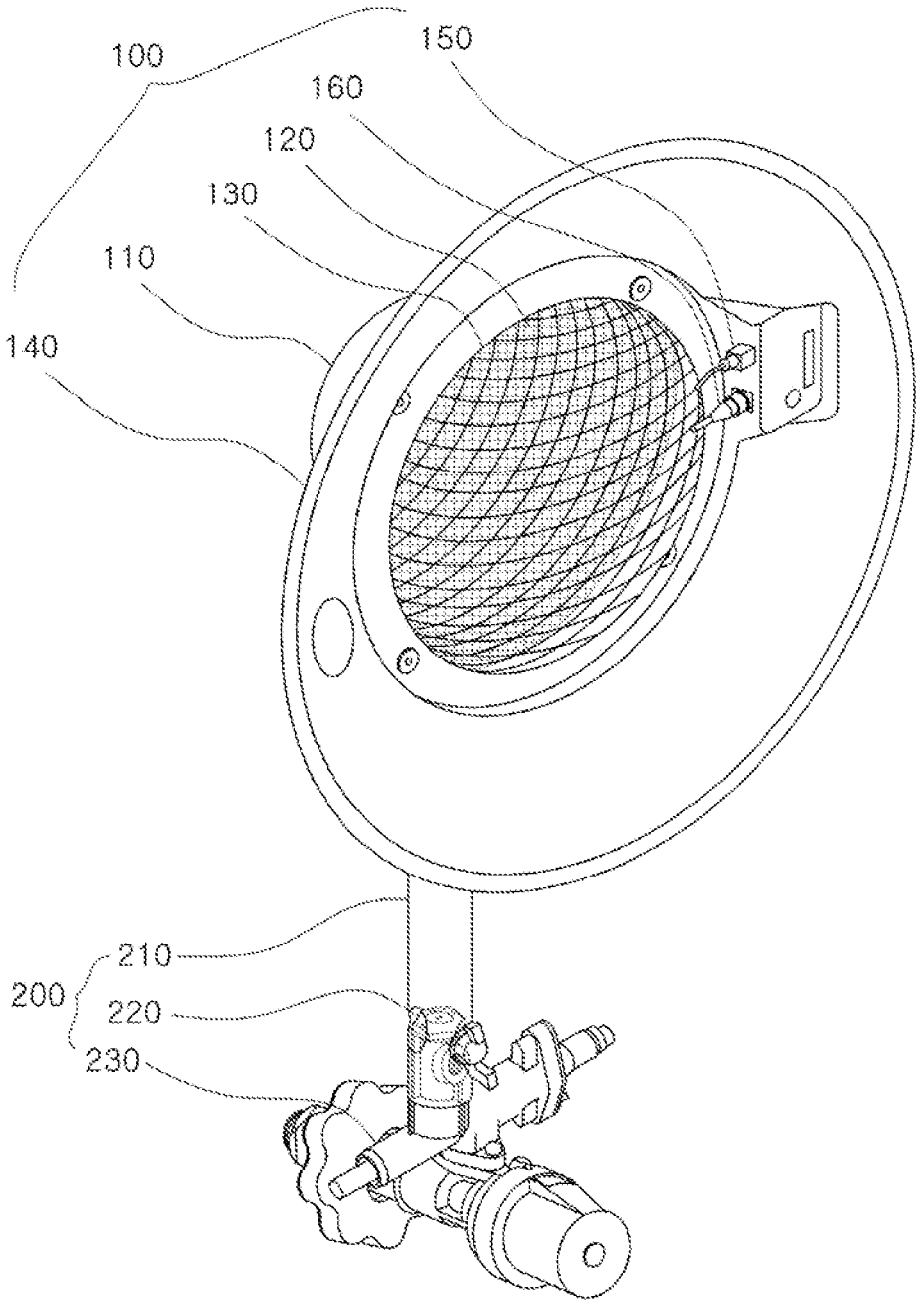
FIG. 13 (RELATED ART)
FIG. 13 is a perspective view showing a head unit of a gas heater according to the related art.
Figure 14:
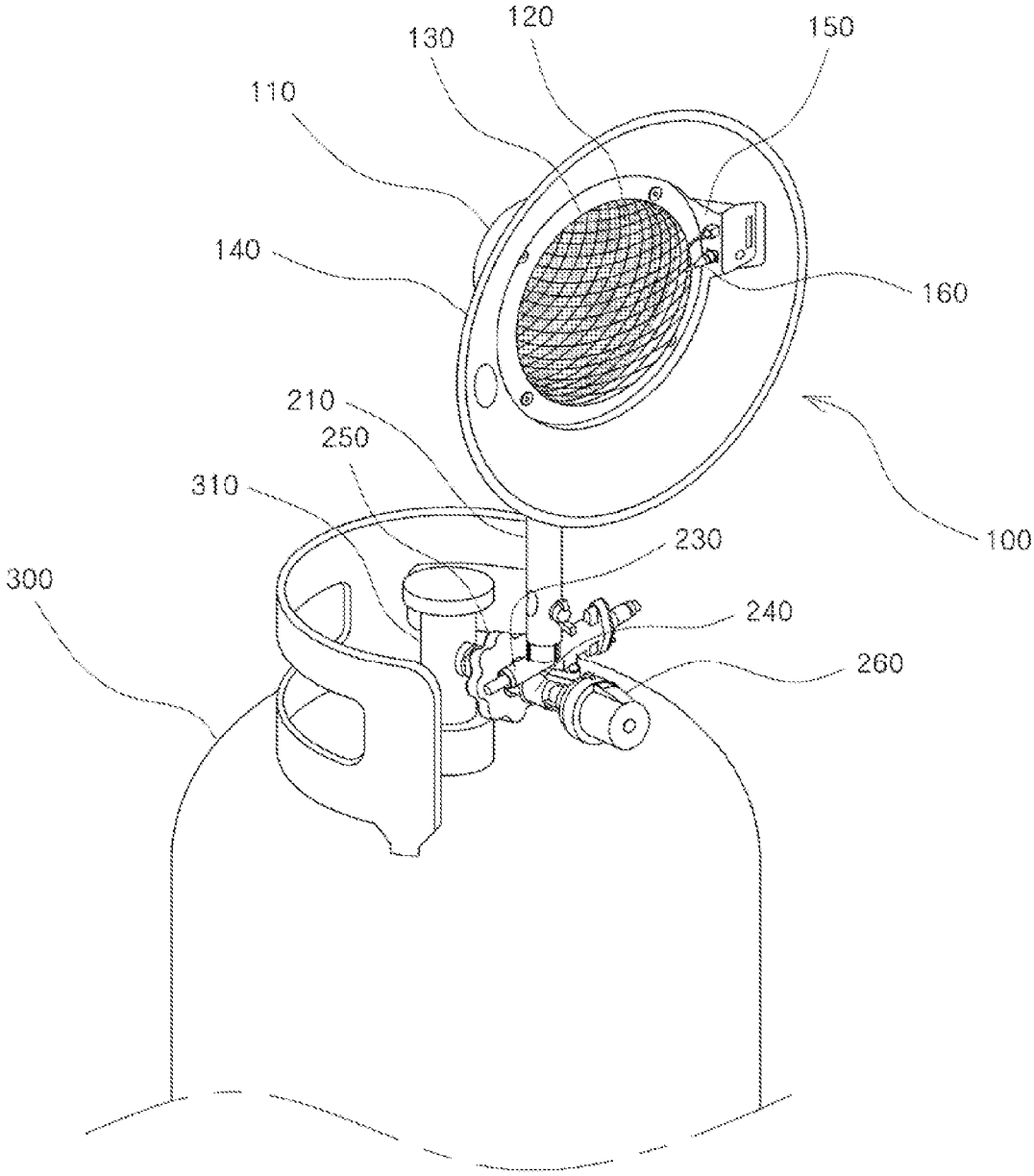
FIG. 14 (RELATED ART)
FIG. 14 is a perspective view showing a gas heater installed to a gas container according to the related art.

FIG. 10 is a perspective view showing a gas heater equipped with a support according to an exemplary embodiment of the present invention.

Referring to FIG. 10, the gas heater is provided with a support. A fuel gas inlet tube 21 is coupled with a mixing chamber 11 of a head unit 10 just below the mixing chamber 11, a safety valve 23 coupled with a gas feeding nozzle 22 is coupled to the fuel gas inlet tube 21 just below the fuel gas inlet tube 21 by a fixing bolt 28, which is screw-coupled into coupling holes 21*a* and 23*a* of the fuel gas inlet tube 21 and the safety valve 23, and a connection member 25 is coupled to the safety valve 23 just below the safety valve 23. Further, a fitting unit 26 is provided at one side of the connection member 25 and an adjustment handle 27 is provided at the other side of the connection member 25 to adjust the heating power by controlling the amount of gas to be fed. A support 30 is installed to the fuel gas inlet tube 21 and includes a vertical section 32 having a fixing hole 31 and fixed to the fuel gas inlet tube 21 by the fixing bolt 28 screw-coupled into the fixing hole 31 and a base 33 provided at a lower end of the vertical section 32 and supported by the top surface of a gas container 40. An upper portion of the vertical section 32 of the support 30 is bent in the form of an n-shape such that the fixing hole 31 is open downward, and a lower portion of the vertical section 32 of the support 30 is bent in the form of an L-shape.

The fixing bolt 28 includes a butterfly bolt that facilitates the fixing work for the support 30.

When the support 30 is installed to the gas container 40, the adjustment handle 27 extends through the lower portion of the vertical section 32, and the fixing bolt 28 fastened into the coupling hole 21*a* of the fuel gas inlet tube 21 and the coupling hole 23*a* of the safety valve 23 is slightly released. Then, a bolt part 28*a* of the fixing bolt 28 is inserted into the fixing hole 31 formed at the upper portion of the vertical section 32 of the support 30 and the fixing bolt 28 is fastened to the vertical section 32 by rotating a head part 28 of the fixing bolt 28 such that the support 30 can be fixed to the gas heater.

At this time, the base 33 of the support 30 is supported on the top surface of the gas container 40 to securely support the gas heater. Thus, the gas heater is not shaken when the user rotates the adjustment handle 27 to use the gas heater.

In addition, a tip-over switch 24 is connected to the safety valve 23 of the gas feeding unit 20 through a wire 50. The tip-over switch 24 is shut off to automatically extinguish fire when the gas heater comes down due to the strong wind or external impact applied thereto, thereby ensuring the safety. The tip-over switch 24 is fixed to the fuel gas inlet tube 21 to install the fire extinguishing safety device in the appropriate position.

In order to install the tip-over switch 24, a bracket 40 prepared as a flat plate is welded to a rear portion of the fuel gas inlet tube 21 and bolt insertion holes 41 and 24*a* are formed in the bracket 40 and the tip-over switch 24, respectively. Then, the bracket 40 and the tip-over switch 24 are fastened to each other by a bolt 24*b* at the rear portion of the fuel gas inlet tube 21.

Since the tip-over switch 24 is installed in the above position, the tip-over switch 24 is hidden by the fuel gas inlet tube 21 when viewed from the front of the gas heater. Thus, the gas heater can be minimized without degrading the aesthetic appearance of the gas heater. In addition, the user may easily manipulate the adjustment handle 27 for the purpose of ignition and heating power control, so that the user can conveniently use the gas heater.

While the invention has been shown and described with reference to certain exemplary embodiments thereof, it will be understood by those skilled in the art that various changes in form and details may be made therein without departing from the spirit and scope of the invention as defined by the claims and their equivalents.

What is claimed is:

1. An outdoor gas heater comprising:

a head unit including a mixing chamber, a primary combustion net fixedly coupled to an upper end of the mixing chamber, and a secondary combustion net fixedly coupled onto the primary combustion net; and a gas feeding unit to feed fuel gas into the head unit, wherein the primary combustion net includes inner and outer combustion nets having a same size, and the inner and outer combustion nets are fixedly coupled with each other while being overlapped with each other to allow the primary combustion net to have a backfire arresting function, and wherein a perforation hole is formed in the inner combustion net of the primary combustion chamber to improve an initial ignition performance.

2. The outdoor gas heater of claim 1, wherein the primary combustion net has a wire thickness of about 0.25 mm and a mesh size of about 38 mesh, and the secondary combustion net has a wire thickness of about 0.6 to 1.0 mm and a mesh size of about 6 mesh.

3. The outdoor gas heater of claim 1, wherein the inner and outer combustion nets of the primary combustion net are fixedly coupled with each other through a spot welding section formed by a spot welding process.

4. The outdoor gas heater of claim 3, wherein the spot welding section of the primary combustion net is prepared in a form of a circular pattern at a center of the inner and outer combustion nets to enhance the backfire arresting function of the primary combustion net.

5. The outdoor gas heater of claim 4, wherein the spot welding section of the primary combustion net is prepared in a form of a strip to enhance the backfire arresting function of the primary combustion net.

6. The outdoor gas heater of claim 4, wherein the spot welding section of the primary combustion net includes a plurality of spots spaced apart from each other at a regular interval to enhance the backfire arresting function of the primary combustion net.

7. The outdoor gas heater of claim 1, wherein a fuel gas inlet tube is coupled to the mixing chamber of the head unit just below the mixing chamber, a safety valve is coupled to the fuel gas inlet tube just below the fuel gas inlet tube by a fixing bolt, which is screw-coupled into coupling holes of the fuel gas inlet tube and the safety valve, a connection member including the fitting unit fitted to a gas container and an adjustment handle is coupled to the safety valve just below the safety valve, and a support is installed to the fuel gas inlet tube, and wherein the support includes a vertical section having a fixing hole and fixed to the fuel gas inlet tube by the fixing bolt screw-coupled into the fixing hole and a base provided at a lower end of the vertical section and supported on a top surface of the gas container, so that the outdoor gas heater is prevented from being shaken in use.

8. The outdoor gas heater of claim 7, wherein an upper portion of the vertical section of the support is bent in a form of an n-shape such that the fixing hole is open downward, and a lower portion of the vertical section of the support is bent in a form of an L-shape.

9. The outdoor gas heater of claim 7, wherein a bracket prepared as a flat plate is provided at a rear portion of the fuel gas inlet tube of the head unit, and a tip-over switch, which is connected to the safety valve by a wire, is fixed to the bracket to ensure safety through auto-fire extinguishing.

10. The outdoor gas heater of claim 1, further comprising:

a reflective plate coupled onto the secondary combustion net of the head unit, wherein an ignition plug and a thermocouple are mounted on a reflective layer such that auto-fire extinguishing is performed by the thermocouple when a backfire occurs, and a wind-proof cover is provided to the thermocouple to protect the thermocouple from external air, thereby preventing unintentional fire extinguishing.

11. The outdoor gas heater of claim 10, wherein the wind-proof cover has a fuel gas discharge hole located corresponding to the ignition plug to improve the initial ignition performance.

12. The outdoor gas heater of claim 10, wherein the wind-proof cover includes a top surface, a front surface and both lateral sides to surround the thermocouple exposed to an outside and a bottom surface of the wind-proof cover is open.

13. The outdoor gas heater of claim 12, wherein an extension surface is formed at a rear of the top surface of the wind-proof cover and the wind-proof cover is fixed to one side of the reflective plate by a fixing unit.

14. The outdoor gas heater of claim 13, wherein the wind-proof cover is fixed to the reflective plate by the fixing unit together with a bracket fitted into a bracket coupling hole of the reflective plate.

* * * * *